US012108800B2

(12) United States Patent
Yang et al.

(10) Patent No.: US 12,108,800 B2
(45) Date of Patent: Oct. 8, 2024

(54) ELECTRONIC ATOMIZER HAVING CHILD LOCK ASSEMBLY AND APPLICATION THEREOF

(71) Applicant: Shenzhen Zun Yi Pin Technology Co., Ltd., Shenzhen (CN)

(72) Inventors: Miaowen Yang, Shenzhen (CN); Gang Huang, Shenzhen (CN); Yajiao Fu, Shenzhen (CN); Huifu Shuai, Shenzhen (CN); Yonghui Lin, Shenzhen (CN)

(73) Assignee: SHENZHEN ZUN YI PIN TECHNOLOGY CO., LTD., Shenzhen (CN)

( * ) Notice: Subject to any disclaimer, the term of this patent is extended or adjusted under 35 U.S.C. 154(b) by 447 days.

(21) Appl. No.: 17/602,560

(22) PCT Filed: Aug. 4, 2020

(86) PCT No.: PCT/CN2020/106676
§ 371 (c)(1),
(2) Date: Oct. 8, 2021

(87) PCT Pub. No.: WO2021/164208
PCT Pub. Date: Aug. 26, 2021

(65) Prior Publication Data

US 2022/0183380 A1 Jun. 16, 2022

(30) Foreign Application Priority Data

Feb. 18, 2020 (CN) ..... 202010100325.2

(51) Int. Cl.
*A24F 47/00* (2020.01)
*A24F 40/10* (2020.01)
(Continued)

(52) U.S. Cl.
CPC ..... *A24F 40/49* (2020.01); *A24F 40/10* (2020.01); *A24F 40/42* (2020.01)

(58) Field of Classification Search
CPC ..... A24F 40/49; A24F 40/10; A24F 40/42; A24F 40/485
See application file for complete search history.

(56) References Cited

U.S. PATENT DOCUMENTS 5,398,701 A 3/1995 Neumann et al.
2009/0194105 A1* 8/2009 Besseler ..... A61M 15/0028 128/203.15
(Continued)

FOREIGN PATENT DOCUMENTS

CN 106510004 A 3/2017
CN 206909705 U 1/2018
(Continued)

OTHER PUBLICATIONS

International Search Report dated Nov. 25, 2020 for PCT/CN2020/106676.
Written Opinion dated Nov. 25, 2020 for PCT/CN2020/106676.

*Primary Examiner* — Abdullah A Riyami
*Assistant Examiner* — Nelson R. Burgos-Guntin
(74) *Attorney, Agent, or Firm* — Farjami & Farjami LLP

(57) ABSTRACT

An electronic atomizer having a child lock assembly and an application thereof. The atomizer includes: a supporting housing, on which a movable cover with one end rotatable around the supporting housing is arranged; an e-liquid bin arranged in a cavity of the supporting housing for storing e-liquid, where an e-liquid injection hole for injecting the e-liquid into the e-liquid bin is formed in the supporting housing; an atomization core arranged in the cavity of the supporting housing for heating and atomizing the e-liquid stored in the e-liquid bin; a smoke guiding tube having an inlet end communicated with the atomization core for intro-
(Continued)

ducing smoke and an outlet end for smoking; a mouthpiece communicated with the smoke guiding tube, where an elastic locking member is arranged between the mouthpiece and the cover, and the mouthpiece, the cover, and the elastic locking member form a child lock assembly.

4 Claims, 2 Drawing Sheets

(51) Int. Cl.
*A24F 40/42* (2020.01)
*A24F 40/49* (2020.01)

(56) References Cited

U.S. PATENT DOCUMENTS

| | | | | |
|---|---|---|---|---|
| 2017/0099877 | A1* | 4/2017 | Worm | A61M 11/042 |
| 2017/0150757 | A1* | 6/2017 | Worm | H05B 1/0244 |
| 2018/0116287 | A1* | 5/2018 | Dai | H05B 3/44 |
| 2018/0271174 | A1* | 9/2018 | Qiu | A24F 40/42 |
| 2019/0197225 | A1* | 6/2019 | Khalifa | G06F 21/305 |
| 2019/0373679 | A1* | 12/2019 | Fu | A24F 7/00 |

FOREIGN PATENT DOCUMENTS

| | | | |
|---|---|---|---|
| CN | 207084118 | U | 2/2018 |
| CN | 209152359 | U | 7/2019 |
| CN | 209498577 | U | 10/2019 |
| CN | 111213913 | A | 6/2020 |

* cited by examiner

ELECTRONIC ATOMIZER HAVING CHILD LOCK ASSEMBLY AND APPLICATION THEREOF

CROSS-REFERENCE TO RELATED APPLICATIONS

This application is a national stage filing under 35 U.S.C. § 371 of international application number PCT/CN2020/106676, filed Aug. 4, 2020, which claims priority to Chinese patent application No. 202010100325.2 filed Feb. 18, 2020. The contents of these applications are incorporated herein by reference in their entirety.

TECHNICAL FIELD

The disclosure relates to the field of electronic technologies, and more particularly, to an electronic atomizer having a child lock assembly and an application thereof.

BACKGROUND

Since 2005, electronic atomizers have been widely used in electronic cigarette products. Manufacturers inject e-liquid into the electronic atomizers to meet the needs of adult users, and the electronic atomizers are often applied to atomization drug delivery devices in some medical fields and atomization disinfection devices in household fields. Main ingredients of the e-liquid are food-grade or pharmaceutical-grade glycerol, propylene glycol and polyethylene glycol, and special flavors for tobacco. Some e-liquids also contain nicotine, which is mainly intended to make the flavor closer to that of cigarettes. Once the e-liquid is eaten by children by mistake, a serious threat will be posed to their health, and once some drugs or disinfection liquids in the atomization drug delivery devices or atomization disinfection devices are eaten by children by mistake, a serious threat will also be posed to their health.

On Jan. 11, 2017, the US Congress passed a bill on the use of a child safety package for the e-liquid, which required that the e-liquid had to use the child safety package, thereby further keeping a stranglehold on children's safety. China is a major exporter of electronic cigarettes, and a package of e-liquid exported from China must also comply with related laws and regulations at abroad on the child safety package. The concept of "child safety package" put forward by the United States is mainly aimed at children under 5 years old, which stipulates a package form with a child safety protection performance, and the design structure can make it difficult for children to open the package or take out a certain number of built-in products within a certain period of time. Children under 5 years old are curious and have a certain imitation ability, but their cognitive ability is poor, and their behaviors are mainly single actions such as "grasping, pressing, twisting, pinching and biting". A burette structure design is adopted in a common e-liquid package, which is colorful, and a volatile fruit flavor may easily attract the attention of young children, resulting in eating by children by mistake.

At present, there are no relevant standards and regulations in China to restrict a package of the electronic atomizers. The existing child safety package in the market is mainly implemented by combining multiple actions instead of a single opening mode, so as to increase the difficulty in opening, such as a pressing and twisting cover, a lifting cover, a labyrinth cover, a drawing cover, and the like. The pressing and twisting cover is widely used, which needs to be opened by pressing and twisting at the same time, thereby increasing the difficulty for children to open the package. These prior arts all have obvious shortcomings. Therefore, it is necessary to develop a new atomizer having a child lock structure.

SUMMARY

In order to overcome the above defects in the prior art, the disclosure provides an electronic atomizer having a child lock assembly and an application thereof, and solves the above technical problems.

The technical solutions used in the disclosure to solve the technical problems are described as follows.

There is provided an electronic atomizer having a child lock assembly including:

- a supporting housing, wherein a movable cover is arranged on the supporting housing, and one end of the cover is capable of rotating around the supporting housing;
- an e-liquid bin arranged in a cavity of the supporting housing and configured for storing e-liquid, wherein the supporting housing is provided with an e-liquid injection hole for injecting the e-liquid into the e-liquid bin, and the e-liquid injection hole is covered by the cover;
- an atomization core arranged in the cavity of the supporting housing and configured for heating and atomizing the e-liquid stored in the e-liquid bin;
- a smoke guiding tube having an inlet end communicated with the atomization core and configured for introducing smoke and an outlet end configured for smoking; and
- a mouthpiece communicated with the smoke guiding tube, wherein an elastic locking member is arranged between the mouthpiece and the cover, and the mouthpiece, the cover, and the elastic locking member form the child lock assembly.

As a preferred solution of the disclosure, an upper end of the supporting housing is provided with an accommodating cavity for the cover, the cover is arranged in the accommodating cavity, one end of the cover is movably connected with one end of the supporting housing through a rotating shaft, and the cover is capable of rotating around the rotating shaft.

As a preferred solution of the disclosure, the e-liquid injection hole is formed in the accommodating cavity and is communicated with the e-liquid bin, a smoke guiding hole is further formed in the accommodating cavity, the smoke guiding hole is communicated with the atomization core, and the smoke guiding tube is communicated with the smoke guiding hole and the mouthpiece.

As a preferred solution of the disclosure, the cover is provided with a silica gel plug at a bottom of the cover for preventing the e-liquid from leaking out of the e-liquid injection hole.

As a preferred solution of the disclosure, the elastic locking member includes a lower positioning sleeve and an upper positioning sleeve matched with the lower positioning sleeve, the lower positioning sleeve is arranged in the smoke guiding hole, an inlet end of the smoke guiding tube is mounted in the upper positioning sleeve, an outlet end of the smoke guiding tube is connected with the mouthpiece by passing through the cover, and the upper positioning sleeve is capable of being clamped with the lower positioning sleeve.

As a preferred solution of the disclosure, the elastic locking member further includes a mouthpiece spring and a baffle ring, the mouthpiece spring is sheathed on an outer wall of the smoke guiding tube, and the mouthpiece spring is connected with the mouthpiece through the baffle ring.

As a preferred solution of the disclosure, the cover is provided with a mouthpiece groove for accommodating the mouthpiece, the mouthpiece is arranged in the mouthpiece groove, and the mouthpiece is capable of rotating in the mouthpiece groove.

There is further provided an electronic cigarette including the atomizer above.

Compared with the prior art, the disclosure has the following beneficial effects.

According to the electronic atomizer having the child lock assembly of the disclosure, for children, disassembly of the atomizer using the child lock assembly with the structure requires specific combination of two operations instead of rotating or pressing, and the disassembly needs to act on a specific part (i.e., the mouthpiece), which is impossible or difficult for children to know, thereby preventing children from contacting or eating atomized e-liquid by mistake, especially the e-liquid of electronic cigarette products using the atomizer, thereby achieving a good child protection effect. Meanwhile, as far as e-liquid injection is concerned, the atomizer can be injected with e-liquid simply by opening the cover, which provides a simple and convenient operation flexibility for an adult user. Moreover, the electronic atomizer is also be applicable to an atomization drug delivery device in a medical field and an atomization disinfection device in a household field and can also play a good role in protecting children.

Figure 1:
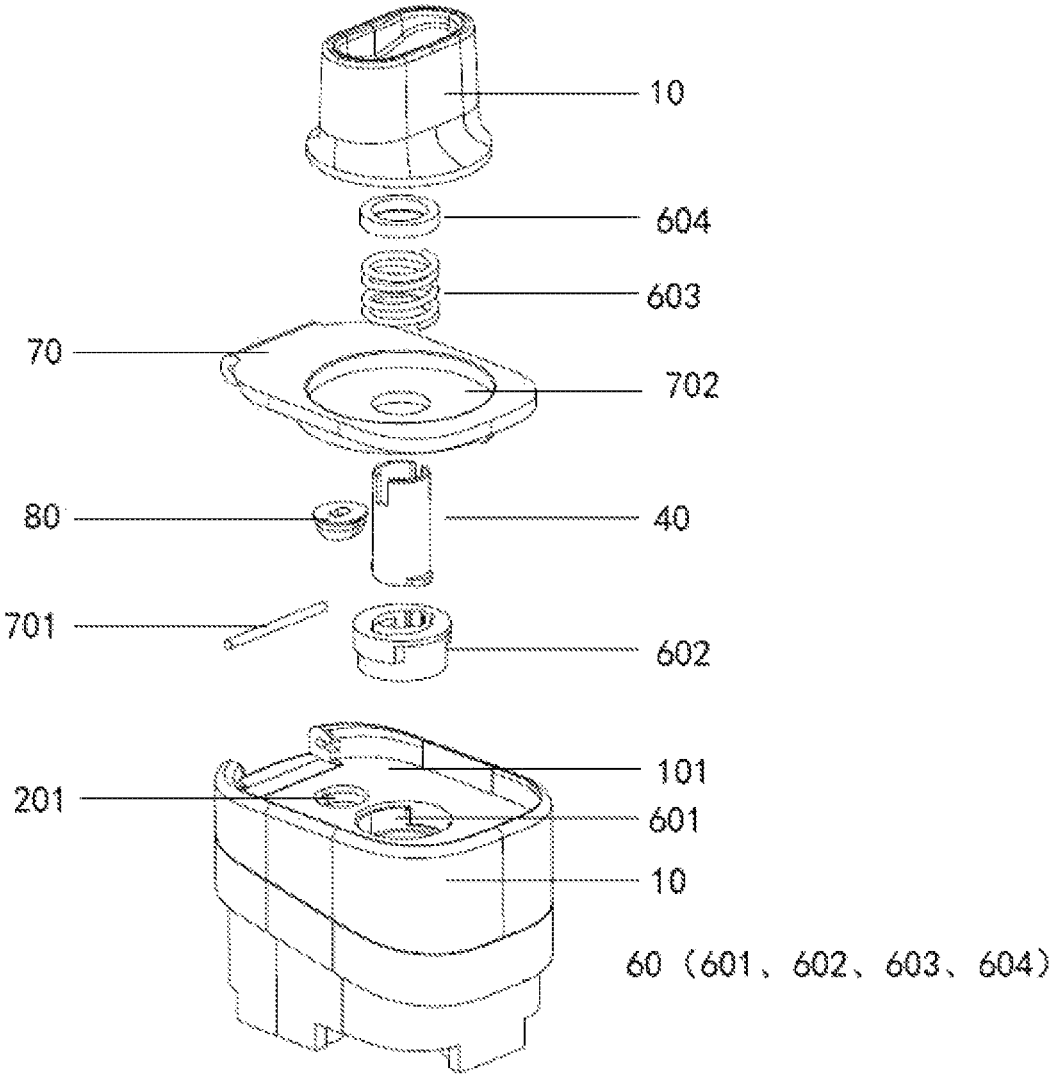
FIG. 1 is an exploded view of an electronic atomizer having a child lock assembly according to the disclosure.
Figure 2:
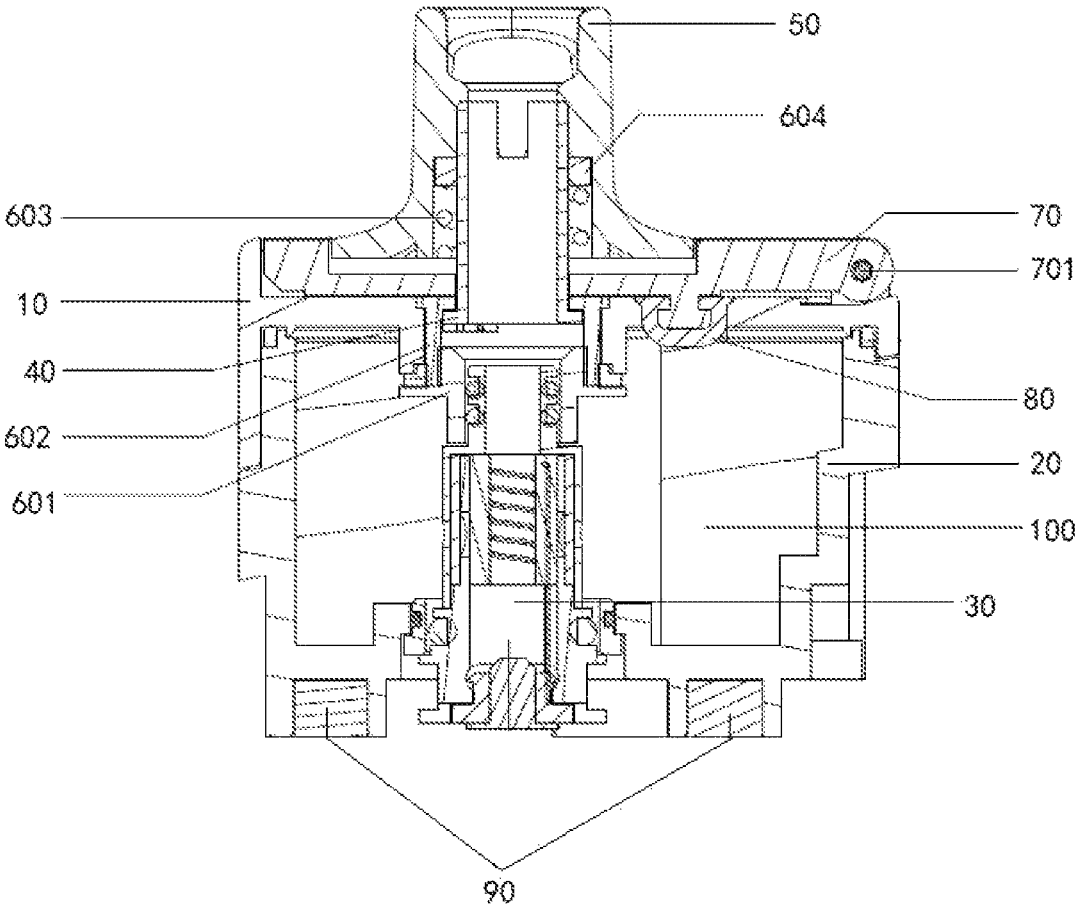
FIG. 2 is a cross-section view of the electronic atomizer having a child lock assembly according to the disclosure.

Numerals in the drawings are as follows: 10 refers to supporting housing; 20 refers to e-liquid bin; 30 refers to atomization core; 40 refers to smoke guiding tube; 50 refers to mouthpiece; 60 refers to elastic locking member; 70 refers to cover; 80 refers to silica gel plug; 90 refers to magnet; 100 refers to e-liquid; 101 refers to accommodating cavity; 102 refers to smoke guiding hole; 201 refers to e-liquid injection hole; 601 refers to lower positioning sleeve; 602 refers to upper positioning sleeve; 603 refers to mouthpiece spring; 604 refers to baffle ring; 701 refers to rotating shaft; and 702 refers to mouthpiece groove.

DETAILED DESCRIPTION

The embodiments of the disclosure are further described hereinafter with reference to the accompanying drawings. It should be noted herein that the descriptions of these embodiments are used to help understand the disclosure, but do not constitute a limitation of the disclosure. In addition, the technical features involved in the embodiments of the disclosure described hereinafter may be combined with each other to derive other embodiments not explicitly described.

As shown in FIG. 1, an atomizer having a child lock assembly includes a supporting housing 10, an e-liquid bin 20, an atomization core 30, a smoke guiding tube 40, and a mouthpiece 50.

The supporting housing 10 is a sealed cylinder having a cavity, a movable cover 70 is arranged above the supporting housing 10, the cover 70 is configured for sealing the supporting housing 10. Further, one end of the cover 70 is capable of rotating around the supporting housing 10 to open and close the cover 70.

The e-liquid bin 20 is arranged in the cavity of the supporting housing 10 and configured for storing e-liquid 100. Further the e-liquid bin 20 is formed by an inner wall of the supporting housing 10, and the supporting housing 10 is provided with an e-liquid injection hole 201 for injecting the e-liquid into the e-liquid bin 20. When the cover 70 is closed, the e-liquid injection hole 201 is covered by the cover 70 to prevent the e-liquid 100 in the e-liquid bin 20 from leaking out of the e-liquid injection hole 201.

The atomization core 30 is arranged in the cavity of the supporting housing 10 and configured for heating and atomizing the e-liquid 100 stored in the e-liquid bin 20 to generate smoke.

The smoke guiding tube 40 is in a vertical structure having an inlet end communicated with the atomization core 30 and configured for allowing air mixed with the smoke to flow out of the atomization core 30 and an outlet end configured for smoking the air mixed with the smoke. In the embodiment, the smoke guiding tube 40 is arranged above the supporting housing 10.

The mouthpiece 50 is communicated with the smoke guiding tube 40, where the air mixed with the smoke in the atomization core 30 is led out from the atomization core 30 through the smoke guiding tube 40, and the air led out is smoked by a user through the mouthpiece 50.

Further, in order to prevent the cover 70 from being opened, an elastic locking member 60 is arranged between the mouthpiece 50 and the cover 70, and the cover 70 is opened and closed by opening and closing the elastic locking member 60, thereby opening or closing the e-liquid injection hole 201, so that the mouthpiece 50, the cover 70 and the elastic locking member 60 form the child Jock assembly.

Further, in order to better close the e-liquid injection hole 201, the cover 70 is provided with a silica gel plug 80 at a bottom thereof for preventing the e-liquid 100 from leaking out of the e-liquid injection hole 201. A size of the silica gel plug 80 is just matched with a size of the e-liquid injection hole 201, and the e-liquid injection hole 201 may be opened and closed through the silica gel plug 80 with opening and closing of the cover 70.

Preferably, an upper end of the supporting housing 10 is provided with an accommodating cavity 101 for the cover 70, the cover 70 is arranged in the accommodating cavity 101, one end of the cover 70 is movably connected with one end of the supporting housing 10 through a rotating shaft 701, and the cover 70 is capable of rotating around the rotating shaft 701.

Further, the e-liquid injection hole 201 is formed in the accommodating cavity 101 and is communicated with the e-liquid bin 20. A user may inject the e-liquid into the e-liquid bin 20 through the e-liquid injection hole 201. Meanwhile, in order to exhaust the smoke generated in the atomization core 30, a smoke guiding hole 102 is further formed in the accommodating cavity 101, the smoke guiding hole 102 is communicated with the atomization core 30, and the smoke guiding tube 40 is communicated with the smoke guiding hole 102 and the mouthpiece 50.

Preferably, the elastic locking member 60 includes a lower positioning sleeve 601 and an upper positioning sleeve 602 matched with the lower positioning sleeve 601.

Specifically, the lower positioning sleeve 601 may be clamped with the upper positioning sleeve 602. In the present application, a common way of clamping by pressing and rotating the upper positioning sleeve 602 is used.

Further, the lower positioning sleeve 601 is arranged on an inner wall of the smoke guiding hole 102, an inlet end of the smoke guiding tube 40 is mounted in the upper positioning sleeve 602, an outlet end of the smoke guiding tube 40 passes through the cover 70 and then is connected with the mouthpiece 50, and the upper positioning sleeve 602 is capable of being clamped with the lower positioning sleeve 601.

Meanwhile, the elastic locking member 60 further includes a mouthpiece spring 603 and a baffle ring 604, the mouthpiece spring 603 is sheathed on an outer wall of the smoke guiding tube 40, and the mouthpiece spring 603 is connected with the mouthpiece 50 through the baffle ring 604.

Preferably, the cover 70 is provided with a mouthpiece groove 702 for accommodating the mouthpiece 50, the mouthpiece 50 is arranged in the mouthpiece groove 702, and the mouthpiece 50 is capable of rotating in the mouthpiece groove 702.

When the cover 70 of the atomizer is in a closed state, the mouthpiece 50 when pressed down drives the baffle ring 604 and the mouthpiece spring 603 to move downwardly, and then the mouthpiece spring 603 drives the smoke guiding tube 40 and the upper positioning sleeve 602 to move downwardly, thereby forming an up-and-down dislocation space between the upper positioning sleeve 602 and the lower positioning sleeve 601. Then, the clamping between the upper positioning sleeve 602 and the lower positioning sleeve 601 is released by rotating the mouthpiece 50 to drive the upper positioning sleeve 602 to rotate, and the cover 70 is opened through the rotating shaft 701, thereby injecting the e-liquid into the e-liquid injection hole 201.

An electronic cigarette includes the atomizer above and a battery assembly for supplying power to the atomizer, and the atomizer is detachably connected with the battery assembly through a magnet 90 at a bottom thereof.

Compared with the prior art, the disclosure has the following beneficial effects.

According to the electronic atomizer having the child lock assembly of the disclosure, for children, disassembly of the atomizer using the child lock assembly with the structure requires specific combination of two operations instead of rotating or pressing, and the disassembly needs to act on a specific part (i.e., the mouthpiece), which is impossible or difficult for children to know, thereby preventing children from contacting or eating atomized e-liquid by mistake, especially the e-liquid of electronic cigarette products using the atomizer, thereby achieving a good child protection effect. Meanwhile, as far as e-liquid injection is concerned, the atomizer can be injected with e-liquid simply by opening the cover, which provides a simple and convenient operation flexibility for an adult user. Moreover, the electronic atomizer is also be applicable to an atomization drug delivery device in a medical field and an atomization disinfection device in a household field and can also play a good role in protecting children.

Finally, it should be noted that: the above is only some embodiments of the disclosure, which are not intended to limit the disclosure. Although the disclosure is described in detail with reference to the above embodiments, those skilled in the art may still modify the technical solutions recorded in the above embodiments, or make equivalent replacements to some of the technical features. Any modification, equivalent substitution, improvement, etc. made within the gist and principle of the disclosure are included in the scope of protection of the disclosure.

What is claimed is:

1. An electronic atomizer comprising:

a child lock assembly;

a supporting housing, wherein a movable cover is arranged on the supporting housing, and one end of the cover is capable of rotating around the supporting housing;

an e-liquid bin arranged in a cavity of the supporting housing and configured for storing e-liquid, wherein the supporting housing is provided with an e-liquid injection hole for injecting the e-liquid into the e-liquid bin, and the e-liquid injection hole is covered by the cover;

an atomization core arranged in the cavity of the supporting housing and configured for heating and atomizing the e-liquid stored in the e-liquid bin;

a smoke guiding tube having an inlet end communicated with the atomization core and configured for introducing smoke and an outlet end configured for smoking; and a mouthpiece communicated with the smoke guiding tube, wherein an elastic locking member is arranged between the mouthpiece and the cover, and the mouthpiece, the cover, and the elastic locking member form the child lock assembly;

wherein an upper end of the supporting housing is provided with an accommodating cavity for the cover, the cover is arranged in the accommodating cavity, one end of the cover is movably connected with one end of the supporting housing through a rotating shaft, and the cover is capable of rotating around the rotating shaft;

wherein the e-liquid injection hole is formed in the accommodating cavity and is communicated with the e-liquid bin, a smoke guiding hole is further formed in the accommodating cavity, the smoke guiding hole is communicated with the atomization core, and the smoke guiding tube is communicated with the smoke guiding hole and the mouthpiece;

wherein the elastic locking member comprises a lower positioning sleeve and an upper positioning sleeve matched with the lower positioning sleeve, the lower positioning sleeve is arranged in the smoke guiding hole, an inlet end of the smoke guiding tube is mounted in the upper positioning sleeve, an outlet end of the smoke guiding tube is connected with the mouthpiece by passing through the cover, and the upper positioning sleeve is capable of being clamped with the lower positioning sleeve;

wherein the clastic locking member further comprises a mouthpiece spring and a baffle ring, the mouthpiece spring is sheathed on an outer wall of the smoke guiding tube, and the mouthpiece spring is connected with the mouthpiece through the baffle ring;

wherein the cover is provided with a mouthpiece groove for accommodating the mouthpiece, the mouthpiece is arranged in the mouthpiece groove, and the mouthpiece is capable of rotating in the mouthpiece groove;

when the cover of the atomizer is in a closed state, the mouthpiece when pressed down drives the baffle ring and the mouthpiece spring to move downwardly, and then the mouthpiece spring drives the smoke guiding tube and the upper positioning sleeve to move downwardly, thereby forming an up-and-down dislocation space between the upper positioning sleeve and the lower positioning sleeve; then, the clamping between the upper positioning sleeve and the lower positioning sleeve is released by rotating the mouthpiece to drive the upper positioning sleeve to rotate, and the cover is opened through the rotating shaft, thereby injecting the e-liquid into the e-liquid injection hole.

2. The electronic atomizer of claim 1, wherein the cover is provided with a silica gel plug at a bottom of the cover for preventing the e-liquid from leaking out of the e-liquid injection hole.

3. An electronic cigarette comprising:

an electronic atomizer including:

a child lock assembly;

a supporting housing, wherein a movable cover is arranged on the supporting housing, and one end of the cover is capable of rotating around the supporting housing;

an e-liquid bin arranged in a cavity of the supporting housing and configured for storing e-liquid, wherein the supporting housing is provided with an e-liquid injection hole for injecting the e-liquid into the e-liquid bin, and the e-liquid injection hole is covered by the cover;

an atomization core arranged in the cavity of the supporting housing and configured for heating and atomizing the e-liquid stored in the e-liquid bin;

a smoke guiding tube having an inlet end communicated with the atomization core and configured for introducing smoke and an outlet end configured for smoking; and a mouthpiece communicated with the smoke guiding tube, wherein an elastic locking member is arranged between the mouthpiece and the cover, and the mouthpiece, the cover, and the elastic locking member form the child lock assembly;

wherein an upper end of the supporting housing is provided with an accommodating cavity for the cover, the cover is arranged in the accommodating cavity, one end of the cover is movably connected with one end of the supporting housing through a rotating shaft, and the cover is capable of rotating around the rotating shaft;

wherein the e-liquid injection hole is formed in the accommodating cavity and is communicated with the e-liquid bin, a smoke guiding hole is further formed in the accommodating cavity, the smoke guiding hole is communicated with the atomization core, and the smoke guiding tube is communicated with the smoke guiding hole and the mouthpiece;

wherein the elastic locking member comprises a lower positioning sleeve and an upper positioning sleeve matched with the lower positioning sleeve, the lower positioning sleeve is arranged in the smoke guiding hole, an inlet end of the smoke guiding tube is mounted in the upper positioning sleeve, an outlet end of the smoke guiding tube is connected with the mouthpiece by passing through the cover, and the upper positioning sleeve is capable of being clamped with the lower positioning sleeve;

wherein the elastic locking member further comprises a mouthpiece spring and a baffle ring, the mouthpiece spring is sheathed on an outer wall of the smoke guiding tube, and the mouthpiece spring is connected with the mouthpiece through the baffle ring;

wherein the cover is provided with a mouthpiece groove for accommodating the mouthpiece, the mouthpiece is arranged in the mouthpiece groove, and the mouthpiece is capable of rotating in the mouthpiece groove;

when the cover of the atomizer is in a closed state, the mouthpiece when pressed down drives the baffle ring and the mouthpiece spring to move downwardly, and then the mouthpiece spring drives the smoke guiding tube and the upper positioning sleeve to move downwardly, thereby forming an up-and-down dislocation space between the upper positioning sleeve and the lower positioning sleeve; then, the clamping between the upper positioning sleeve and the lower positioning sleeve is released by rotating the mouthpiece to drive the upper positioning sleeve to rotate, and the cover is opened through the rotating shaft, thereby injecting the e-liquid into the e-liquid injection hole.

4. The electronic cigarette of claim 3, wherein the cover is provided with a silica gel plug at a bottom of the cover for preventing the e-liquid from leaking out of the c-liquid injection hole.

* * * * *